US007579780B2

(12) United States Patent
Tamida et al.

(10) Patent No.: US 7,579,780 B2
(45) Date of Patent: Aug. 25, 2009

(54) POWER SUPPLY APPARATUS

(75) Inventors: Taichiro Tamida, Tokyo (JP); Takafumi Nakagawa, Tokyo (JP); Ikuro Suga, Tokyo (JP); Hiroyuki Osuga, Tokyo (JP); Toshiyuki Ozaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 150 days.

(21) Appl. No.: 11/866,062

(22) Filed: Oct. 2, 2007

(65) Prior Publication Data

US 2008/0246405 A1 Oct. 9, 2008

(30) Foreign Application Priority Data

Oct. 4, 2006 (JP) ..... 2006-272858

(51) Int. Cl.
*H05B 31/26* (2006.01)

(52) U.S. Cl. ..... 315/111.81; 315/111.41; 315/111.61

(58) Field of Classification Search ..... 315/111.01, 315/111.21, 111.41, 111.61–111.91; 313/362.1; 219/121.51, 121.52, 121.55
See application file for complete search history.

(56) References Cited

U.S. PATENT DOCUMENTS 5,838,120 A * 11/1998 Semenkin et al. ..... 315/505
6,208,080 B1 * 3/2001 King et al. ..... 315/111.41
6,960,888 B1 * 11/2005 Foster ..... 315/111.81
2007/0145901 A1 6/2007 Tamida et al.

FOREIGN PATENT DOCUMENTS

JP 2005-282403 10/2005

OTHER PUBLICATIONS

Naoji Yamamoto et al., "Discharge Current Oscillation in Hall Thrusters", Journal of Propulsion and Power, May 27, 2005, 7 pages.

* cited by examiner

*Primary Examiner*—Douglas W Owens
*Assistant Examiner*—Jimmy T Vu
(74) *Attorney, Agent, or Firm*—Oblon, Spivak, McClelland, Maier & Neustadt, P.C.

(57) ABSTRACT

A power supply apparatus for controlling an ion accelerator includes a controller configured to adjust magnitude of ion acceleration in the ion accelerator. The controller controls an anode voltage applied to an anode electrode of the ion accelerator, a gas flow rate of gas flowing through a gas flow rate regulator of the ion accelerator, and magnetic flux density at an ion exit of the ion accelerator to satisfy a formula given as follows:

$$500 \times 10^9 < \frac{\beta \cdot V_a \cdot Q}{d \cdot S \cdot B^2}$$

where S is a sectional area of the ion exit [$m^2$]; d is an ion accelerating region length [m]; β is a magnetic flux bias ratio; Va is anode voltage [V]; Q is gas flow rate [sccm]; and B is magnetic flux density at the ion exit [T].

4 Claims, 6 Drawing Sheets

POWER SUPPLY APPARATUS

CROSS-REFERENCE TO RELATED APPLICATIONS

This application is based upon and claims the benefit of priority from Japanese Patent Application No. 2006-272858, filed on Oct. 4, 2006, the entire contents of which are incorporated herein by reference.

BACKGROUND OF THE INVENTION

1. Field of the Invention

This invention relates to a power supply apparatus for use in an ion accelerator which is a discharging device for accelerating ions and more particularly to a Hall thruster serving as an electric propulsion device mounted on an artificial satellite.

2. Description of the Related Art

A Hall thruster ionizes gas introduced from one end of an annular-shaped discharging channel, accelerates the ionized gas and ejects the gas from the other end of the discharging channel. A thrust of a Hall thruster can be provided due to the reaction of the ions thus produced. A magnetic flux is radially formed in the annular-shaped discharging channel. The Hall effect by the magnetic flux allows electrons to circumferentially drift in the annular-shaped discharging channel so that the movement of the electrons is suppressed in an axial direction. Thus, only the ions can be effectively accelerated (for example, see JP-A-2002-517661).

One of the problems in stably operating the Hall thruster is occurrence of a discharge oscillation phenomenon. The discharge oscillation phenomenon includes various kinds of oscillation phenomena, which include the discharge oscillation phenomenon at the lowest frequency called "ionization oscillation." In this discharge oscillation phenomenon, an oscillation is generated in the current waveform of the anode current, at a frequency of about 10 kHz, thereby having serious effects on stability, reliability and endurance of a system incorporating the Hall thruster. In order to obviate such inconvenience, a control technique for suppressing this discharge oscillation phenomenon has been demanded (for example, see Kyouichi Kuriki and Yoshihiro Arakawa, "Introduction to Electric Propulsion Rockets," University of Tokyo Press, pp. 152-154, 2003, Japan). Further, a condition for generating the discharge oscillation phenomenon in the Hall thruster has been previously formulated using a relatively simpler model (for example, see N. Yamamoto, K. Komurasaki and Y. Arakawa, "Discharge Current Oscillation in Hall Thrusters," Journal of Propulsion and Power, Vol. 21, No. 5, pp. 870-876, 2005).

In a conventional power supply apparatus, when a load begins to exhibit an unstable behavior due to changes in an anode current, an anode current signal is fed back to a power supply control unit to suppress changes in the anode current, thereby suppressing the discharge oscillation phenomenon (for example, see JP-A-2005-282403).

In the conventional power supply apparatus, when the anode current varies, the anode current signal is fed back to the power supply unit, thereby suppressing the anode current. However, in such a technique of detecting that the anode current has begun to vary, since the discharge oscillation phenomenon is not theoretically suppressed, it is difficult to essentially enhance the stability of the Hall thruster. Further, the discharge oscillation phenomenon occurs at the frequency of e.g. 10 kHz. For this reason, when it is intended to suppress the oscillation by the feed-back to the power supply control unit, a very high speed control system is required. If the control system cannot deal with a high speed response, stable control cannot be realized, and the oscillation phenomenon occurs between the power supply apparatus and the control system so that unstability of the Hall thruster may be promoted. Moreover, when the condition for driving the Hall thruster is optimized while aiming at the effect different from stability of the current in a specific operating condition, disadvantageously, the Hall thruster cannot be stably controlled.

SUMMARY OF THE INVENTION

The present invention has been accomplished in order to solve the problems described above. An object of this invention is to provide a power supply apparatus capable of stably operating a Hall thruster that serves as an ion accelerator by suppressing occurrence of a discharge oscillation phenomenon in a specific operating condition such as a case where high thrusting efficiency is required.

According to a first aspect of the invention, there is provided a power supply apparatus for controlling an ion accelerator that includes an anode electrode, a gas flow rate regulator and a magnetic field generating coil, the power supply apparatus including: a controller configured to control: an anode voltage applied to the anode electrode; a gas flow rate of gas flowing through the gas flow rate regulator; and magnetic flux density at an ion exit of the ion accelerator by controlling coil current flowing through the magnetic field generating coil, thereby adjusting magnitude of ion acceleration in the ion accelerator, wherein, based on: a sectional area of the ion exit of the ion accelerator; an ion accelerating region length of the ion accelerator; and a magnetic flux bias ratio indicating a ratio of the magnetic flux density at the ion exit to an average value of the magnetic flux density in an ion accelerating direction of the ion accelerator, the controller controls the anode voltage, the gas flow rate and the magnetic flux density at the ion exit that depends on the coil current, in order to satisfy a formula given as follows:

$$500 \times 10^9 < \frac{\beta \cdot V_a \cdot Q}{d \cdot S \cdot B^2}$$

where S is the sectional area of the ion exit [$m^2$]; d is the ion accelerating region length [m]; β is the magnetic flux bias ratio; Va is the anode voltage [V]; Q is the gas flow rate [sccm]; and B is the magnetic flux density at the ion exit [T].

According to a second aspect of the invention, there is provided a power supply apparatus for controlling an ion accelerator that includes an anode electrode, a gas flow rate regulator and a magnetic field generating coil, the power supply apparatus including: a controller configured to control: an anode voltage applied to the anode electrode; a gas flow rate of gas flowing through the gas flow rate regulator; and magnetic flux density at an ion exit of the ion accelerator by controlling coil current flowing through the magnetic field generating coil, thereby adjusting magnitude of ion acceleration in the ion accelerator, wherein, based on an ion accelerating region length of the ion accelerator and a magnetic flux bias ratio indicating a ratio of the magnetic flux density at the ion exit to an average value of the magnetic flux density in an ion accelerating direction of the ion accelerator, the controller controls the anode voltage and the magnetic flux density at the ion exit that depends on the coil current to satisfy a formula given as follows:

$$0 \le \frac{\beta \cdot V_a}{d \cdot B} < 370 \times 10^3$$

where d is the ion accelerating region length [m]; β is the magnetic flux bias ratio; Va is the anode voltage [V]; and B is the magnetic flux density at the ion exit [T].

DETAILED DESCRIPTION OF THE PREFERRED EMBODIMENTS

Embodiment 1

Figure 1:
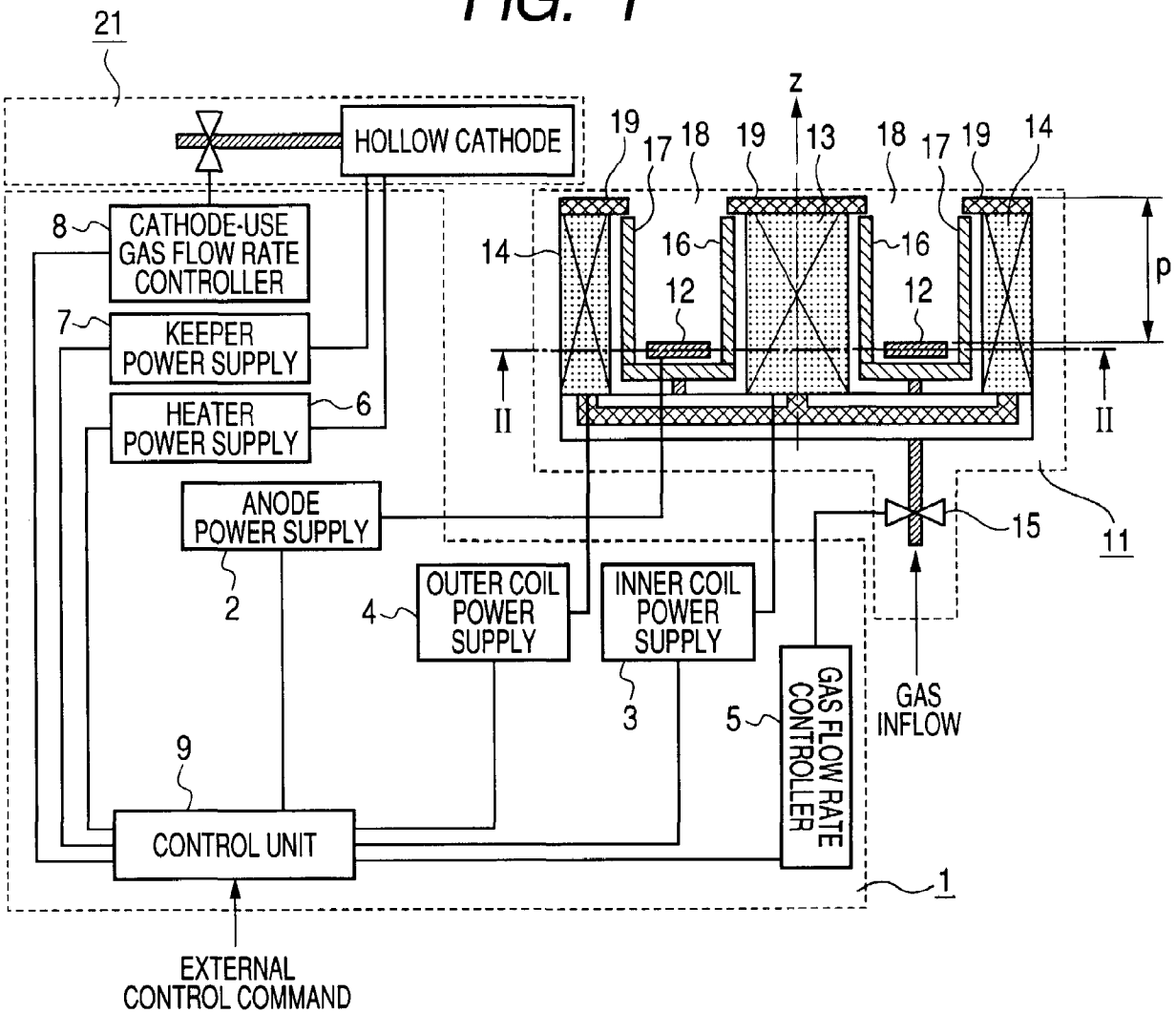
FIG. 1 is a block diagram of a power supply apparatus showing the first embodiment of this invention.
Figure 2:
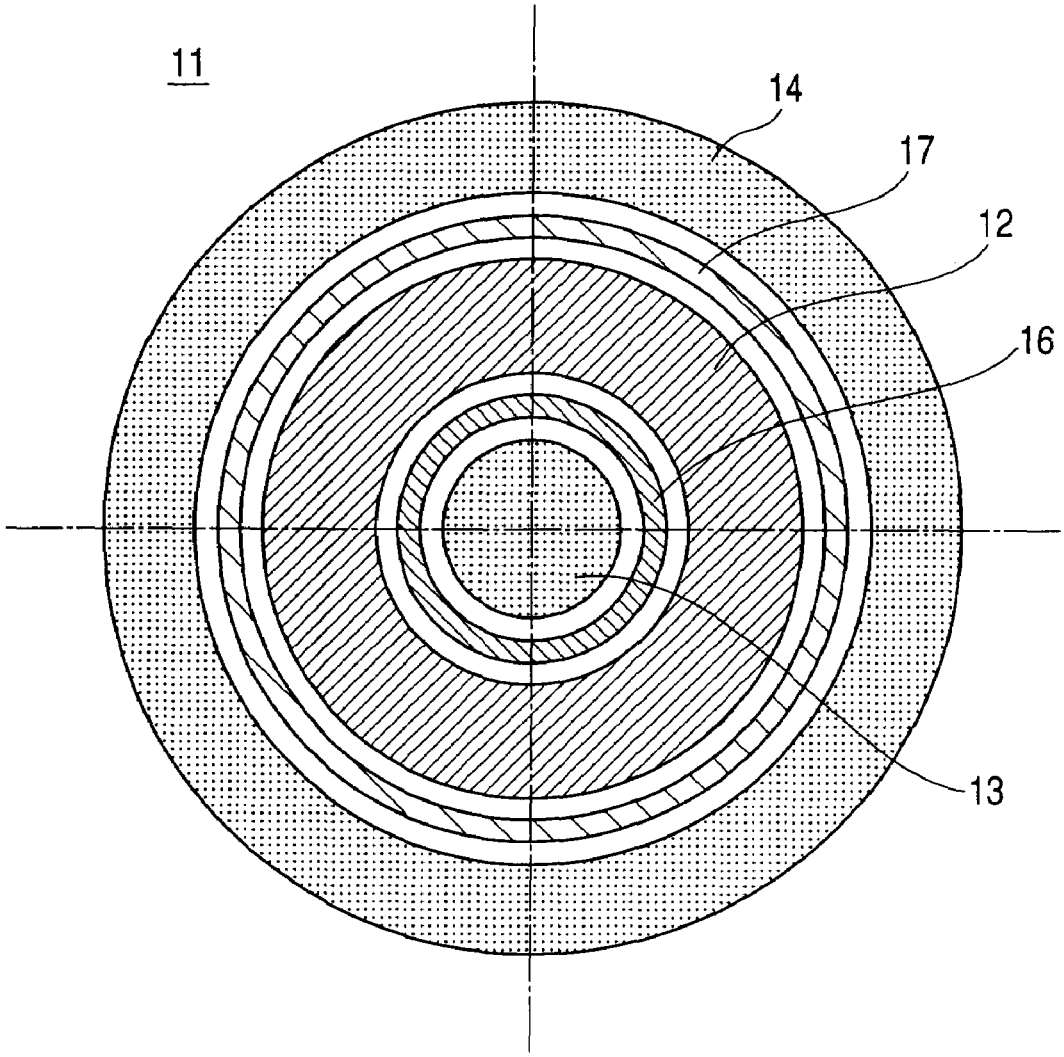
FIG. 2 is a sectional view of the Hall thruster in the first embodiment of this invention.

FIG. 1 is a block diagram of a power supply apparatus according to the first embodiment of the invention. In FIG. 1, a power supply apparatus 1 controls a Hall thruster 11 serving as an ion accelerator and a hollow cathode 21 that supplies electrons to the Hall thruster 11. In FIG. 1, the Hall thruster 11 is illustrated in its sectional view taken in a plane passing the central axis of the Hall thruster 11 which has an annular-shape and being in parallel to the central axis. The Hall thruster 11 includes: an anode electrode 12; an inner coil 13 and an outer coil 14 as magnetic field generating coils; a gas flow rate regulator 15; and an inner ring 16 and an outer ring 17 which form a circular ion accelerating region 18. FIG. 2 is a sectional view taken in line II-II in FIG. 1 (sectional view in a plane perpendicular to the axial direction of the Hall thruster 11). Each of the anode electrode 12, the outer coil 14, the inner ring 16 and outer ring 17 has an annular shape.

Gas to be ionized is introduced from the bottom side (lower side in FIG. 1) of the ion accelerating region 18. The introduced gas serves to generate gas discharge in the ion accelerating region 18. On the bottom side, the anode electrode 12 is provided. By an anode voltage applied to the anode electrode 12, gas particles are accelerated in the axial direction of the Hall thruster 11 toward the ion exit side which is an opposite side (i.e., upper side in FIG. 1) to the bottom of the ion accelerating region 18. The gas particles thus accelerated are ejected from the ion exit. The inner coil 13 and outer coil 14 are respectively provided inside and outside the ion accelerating region 18 for generating magnetic field in a radial direction of the Hall thruster 11. The inner coil 13 and the outer coil 14 are connected to each other by a magnetic material on the anode electrode 12 side, thereby forming a magnetic circuit. On the ion exit side, pole pieces 19 are provided for controlling the magnetic flux density. Generally, the pole pieces 19 are designed so that the magnetic flux generated in each of the coils 13, 14 is strongest at a position of the ion exit and weakest on the anode electrode 12 side.

It is necessary to supply electrons to generate the gas discharge. Further, in order to prevent an artificial satellite body incorporating the Hall thruster 11 from being electrically charged by the ions accelerated and emitted, an electron source is required. In this embodiment, the hollow cathode 21 is provided in the vicinity of the ion exit of the Hall thruster 11, and electrons are supplied from the hollow cathode 21 to the Hall thruster 11. In such a system of the Hall thruster, a power supply and a control system are required for driving and controlling the Hall thruster 11 and hollow cathode 21.

For controlling the Hall thruster 11, the power supply apparatus 1 includes: an anode power supply 2; a coil power supply containing an inner coil power supply 3 and outer coil power supply 4; a gas flow rate controller 5. For controlling the hollow cathode 21, the power supply apparatus 1 includes: a heater power supply 6; a keeper power supply 7; and a cathode-use gas flow rate controller 8. The power supply apparatus further includes a control unit 9 for controlling these elements 2 to 8. The power supply apparatus 1 controls the Hall thruster 11 serving as an ion accelerator provided with: the anode electrode 12; the magnetic field generating coils, i.e. inner coil 13 and outer coil 14; and gas flow rate regulator 15. Specifically, the anode power supply 2 applies an anode voltage Va to the anode electrode 12. The inner coil power supply 3 and the outer coil power supply 4 (which serve as the coil power supplies) supply a coil current Ic to the inner coil 13 and the outer coil 14 (which serve as the magnetic field generating coils), respectively. The gas flow rate controller 5 regulates the gas flow rate Q through the gas flow rate regulator 15. The control unit 9 controls the anode voltage applied to the anode electrode 12, coil current supplied to the magnetic field generating coils (i.e., inner coil 13 and outer coil 14), and flow rate of the gas supplied through the gas flow rate regulator 15, thereby adjusting the magnitude of ion acceleration in the ion accelerator, i.e. Hall thruster 11, and controlling the anode electrode, coil current and gas flow rate in accordance with the function related to at least the anode voltage and coil current.

The gas flow rate controller 5 controls the gas flow rate Q in a gas introducing unit of the Hall thruster 11 in accordance with a command sent from the control unit 9. Further, in accordance with the instruction sent from the control unit 9, the inner coil power supply 3 and outer coil power supply 4 control the coil current Ic flowing through the inner coil 13 and the outer coil 14. Generally, the coil current Ic which is generally a constant DC current flows through the inner coil 13 and the outer coil 14, thereby generating a constant magnetic field within the ion accelerating region 18. The current flowing through the inner coil 13 and the current flowing through the outer coil 14 respectively controlled by the inner coil power supply 3 and outer coil power supply 4 can be set independently of each other. Thus, the magnetic flux density and magnetic field distribution with the ion accelerating region 18 can be finely adjusted. In this embodiment, the coil currents Ic having equal current values flows through the inner coil 13 and the outer coil 14.

The anode power supply 2 controls the anode voltage to be applied to the anode electrode 12. During a normal operation, the anode voltage Va having a constant value is applied to the anode electrode 12. The ions are accelerated by the anode voltage Va so that thrust of the Hall thruster 11 can be obtained. The anode voltage Va is generally set within a range of 100 to 400 V. On the circuit, the ion current based on the accelerated ions and electron current based on the drift of electrons within a discharging channel flow by the anode power supply 2. Therefore, the anode power supply 2 serves as a unit for supplying energy giving the thrust of the Hall thruster 11 and a power supply having the largest capacity in the system for the Hall thruster 11.

The hollow cathode 21 serving as the electron source is controlled by: the cathode-use gas flow rate controller 8 for supplying gas to the hollow cathode 21; the heater power supply 6 for heating the cathode of the hollow cathode; and keeper power supply 7 for stably keeping the flow of electrons from the hollow cathode 21.

The control unit 9 for driving the Hall thruster 11 is controlled by a system of the artificial satellite on which the Hall thruster 11 is mounted (not shown) or a command from the ground (not shown). In this embodiment, the control unit 9 controls at least the anode power supply 2, coil power supplies 3, 4 and gas flow rate controller 5.

In driving the Hall thruster 11, as the case may be, a discharge oscillation phenomenon occurs. The occurrence of the discharge oscillation phenomenon is attributable to various factors such as a device structure of the Hall thruster 11, magnetic field distribution, and anode voltage. The discharge oscillation phenomenon does not occur under a specific condition. The parameters which can be externally controlled during the operation of the Hall thruster 11 are three, i.e. the anode voltage Va, gas flow rate Q and coil current Ic. The driving condition of the hollow cathode 21 does not so greatly depend on the discharge oscillation phenomenon.

Figure 3A:
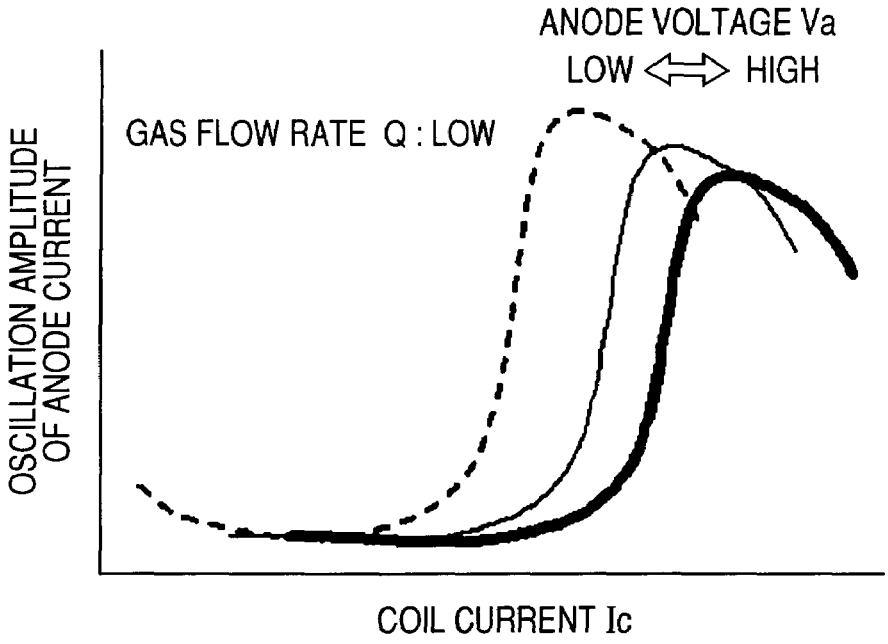
FIGS. 3A and 3B are graphs showing the dependency of the oscillation amplitude of the anode current on three parameters of Va, Q and Ic in the first embodiment of this invention.
Figure 3B:
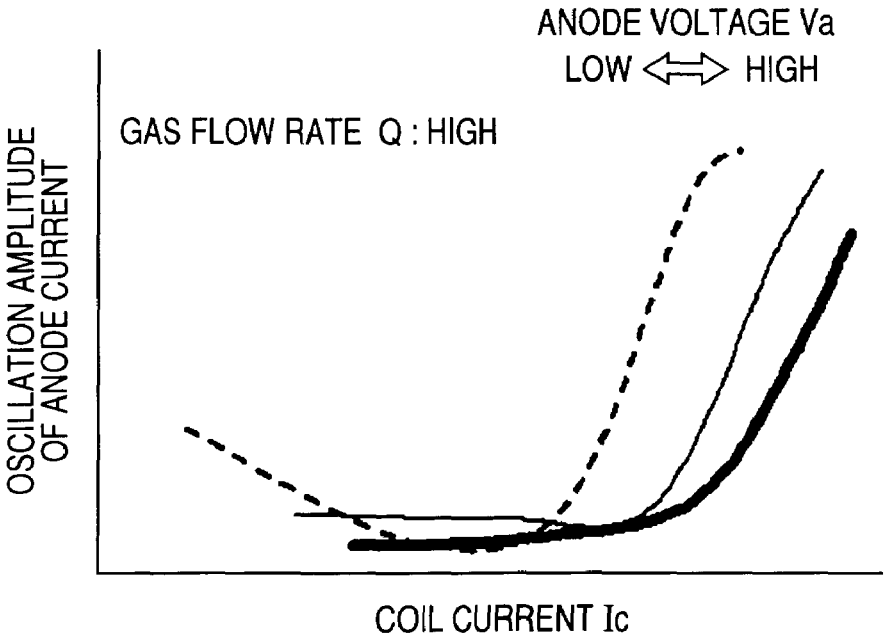

FIGS. 3A and 3B schematically illustrates an example of the experimental result carried out on the dependency of the oscillation amplitude of the anode current on the three parameters, i.e. anode voltage Va, gas flow rate Q and coil current Ic. The amplitude of the discharge oscillation can be determined from the oscillation amplitude of the anode current. In FIGS. 3A and 3B, the horizontal axis represents the coil current Ic and the vertical axis represents the oscillation amplitude of the anode current. FIG. 3A illustrates the relationship between the coil current Ic and the oscillation amplitude of the anode current when the gas flow rate Q is low. FIG. 3B illustrates the relationship between the coil current Ic and the oscillation amplitude of the anode current when the gas flow rate Q is high. As understood from FIGS. 3A and 3B, the oscillation amplitude of the anode current depends on each of the anode voltage Va, the gas flow rate Q and the coil current Ic. Thus, the oscillation amplitude of the anode current can be correlated as a function of these three parameters. Namely, the amplitude of the discharge oscillation can be related to a function of the anode voltage Va, the gas flow rate Q and the coil current Ic.

In this way, there can be obtained a database which represents that the oscillation amplitude of the anode current is smaller if what value the anode voltage Va, the gas flow rate Q and the coil current Ic take. Thus, there can be obtained a function related to such an anode voltage Va and coil current Ic as suppressing the oscillation of the anode current corresponding to the quantity of accelerated ions which is an output of the ion accelerator. By controlling the anode voltage Va, the gas flow rate Q and the coil current Ic according to this function by means of the control unit 9, the oscillation of the anode current can be suppressed. In other words, the oscillation of the anode current can be avoided by controlling the anode voltage Va, the gas flow rate Q and the coil current Ic.

The anode voltage Va and gas flow rate Q are very important parameters in order to determine the thrust of the Hall thruster 11. When the Hall thruster 11 is operated on a specific thrust, in many cases, the anode voltage Va and the gas flow rate Q are mostly preset. On the other hand, the coil current Ic can be freely selected as long as it is within a certain range. Further, the gas flow rate Q takes a time to follow its preset value whereas the coil current Ic can relatively easily follow its preset value. For this reason, when the anode voltage Va and the gas flow rate Q are input as external control commands, and the respective values of the anode voltage Va, the gas flow rate Q and the coil current Ic are regulated, it is suitable to set the coil current Ic in comparison between a combination of these values and the database.

An explanation will be given of combinations of the parameters of the anode voltage Va, the gas flow rate Q and the coil current Ic, which are not likely to generate the discharge oscillation phenomenon. The database of combinations of these three parameters of the anode voltage Va, the gas flow rate Q and the coil current Ic which are not likely to generate the discharge oscillation phenomenon can be obtained by carrying out an experiment for measuring the oscillation amplitude over all the variable ranges of the three parameters. Hall thruster 11 is driven by the power supply apparatus 1 by selecting the condition of the combination of the three parameters not likely to generate the discharge oscillation phenomenon from the database thus obtained. Further, when the anode voltage Va and gas flow rate Q transiently vary, a preset value of the coil current Ic to be varied simultaneously can be determined. It is also theoretically possible to control the Hall thruster 11 using the database.

However, in order to obtain the database, it is necessary to carry out the experiment for measuring the oscillation amplitude of the anode current over all the variable ranges of the three parameters. Further, even if the database which represents the oscillation amplitude of the anode current is acquired over the variable ranges of the three parameters, it is uncertain whether or not there is the value of the coil current Ic capable of suppressing the oscillation of the anode current within all the variable ranges of the anode voltage Va and the gas flow rate Q. In order to avoid such inconvenience, it is necessary to formulate the condition of generating the oscillation of the anode current on the basis of a physical theory and establish a method for control based on the mathematical formulae thus obtained.

As regards formulating the condition for occurrence of oscillation, for example, as described as Equation 22 in the document entitled "Discharge Current Oscillation in Hall Thrusters," the condition equation for suppressing the discharge oscillation phenomenon can be expressed by Formula (1)

$$(v_{ea}-v_{ex})>k_i\overline{N_n}L \tag{1}$$

where ki is an ionizing frequency; Nn is an neutral atom density and L is a representative length in the axial direction of a region where ionization occurs. As shown in FIG. 1, generally, the Hall thruster 11 is designed so that the magnetic flux density is maximized at the ion exit. Thus, the region where ionization occurs is located in the vicinity of the ion exit. The term vea denotes an electron velocity in the plane on the side of the anode electrode 12 in the region where ionization occurs. The term vex denotes an electron velocity in the plane on the side of the ion exit in the region where ionization occurs. Now, attention is paid to the electron velocity in the left side. First, the electron velocity Ve, as described as Formula 10 in the document entitled "Discharge Current Oscillation in Hall Thrusters," can be expressed by Formula (2), using an electron mobility μ.

$$Ve = \mu E + \frac{D}{N_e}\nabla N_e = \mu\left(E + \frac{k_B T_e}{q_e}\frac{\nabla N_e}{N_e}\right) \quad (2)$$

where μ is an electron mobility; E is an electric field strength, D is a diffusion coefficient, Ne is an electron density, kB is a Boltzman's constant, Te is a electron temperature and qe is a charge quantity of an electron. If the effect of diffusion is neglected, only the term of drift based on the electric field in the first term of the right side remains. Meanwhile, the mobility μc, if classical diffusion is presumed, can be expressed by Formula (3)

$$\mu_c = \frac{m\nu}{q_e B^2} = \frac{mk_m}{q_e B^2} N_n \quad (3)$$

where B is a magnetic flux density, ν(=km·Nn) is a frequency of collision of an electron and Nn is gas density. Next, it is assumed that the magnetic flux density B is proportional to the coil current Ic, and the gas density Nn is proportional to the gas flow rate Q. Also, it is assumed that the gas density Nn is inversely proportional to an exit sectional area S of the ion exit which is an exit of the Hall thruster 11 serving as the ion accelerator. The exit sectional area S represents the area of an annular-shaped region encircled by the outer wall of the inner ring 16 and the inner wall of the outer ring 17 shown in FIG. 2. In the Hall thruster 11, the electric field strength E, which is stronger in a region with a higher magnetic flux density, depends on the distribution in the axial direction of the magnetic flux density. Now, the axial direction of the magnetic flux density represents an ion accelerating direction in the ion accelerator and the radial direction of the magnetic flux density represents the direction perpendicular to the axial direction of the magnetic flux.

If it is assumed that the distribution of the component in the radial direction along the axial direction z is B(z), and the component in the radial direction of the magnetic flux density at the ion exit is B, in the distribution of B(z), as described with reference to FIG. 1, generally, the magnetic flux density B at the ion exit is highest and hence the occurrence of plasma is nearly the strongest in the vicinity thereof. Therefore, "B" may be regarded as the typical value of a magnetic flux density. The magnetic flux bias ratio β, which is a ratio of the magnetic flux density at the ion exit to the average value of the magnetic flux density in the axial direction or the ion accelerating direction, can be defined as Formula (4)

$$\beta = \frac{B}{\frac{1}{d}\int_{Anode}^{Exit} B(z)\,dz} \quad (4)$$

where d is an ion accelerating region length which is the length of an ion accelerating region 18 of the Hall thruster 11 serving as the ion accelerator. The ion accelerating region length d represents the distance from the anode electrode 12 to the ion exit. The integration is the integration for the axial direction distance from the anode electrode 12 (Anode) to the ion exit (Exit). The magnetic flux bias ratio β, ion accelerating region length d and exit sectional area S of the ion exit are parameters depending on the shape or design of the Hall thruster 11. If it is assumed that the hollow cathode 21 serving as a cathode is located at the position sufficiently near the ion exit, by using the magnetic flux bias ratio β, the electric field strength Ex at the ion exit can be approximately expressed by Formula (5)

$$E_x = \frac{\beta \cdot V_a}{d} \quad (5)$$

In the case of the classical diffusion, from Formula (2) and Formula (5), the electron velocity Ve_c can be expressed by Formula (6)

$$V_{e_c} \cong \mu_c E \propto \frac{\beta \cdot V_a \cdot Q}{d \cdot S \cdot B^2} \propto \frac{V_a \cdot Q}{I_c^2} \quad (6)$$

If the electron velocity exhibits this dependency, the left side in Formula (1) should also exhibit a similar dependency. Namely, the likelihood of occurrence of oscillation can be rearranged in the form of the right side in Formula (6). For this reason, using the relationship obtained in Formula (6), the relationship between $(\beta \cdot Va \cdot Q)/(d \cdot S \cdot B^2)$ and the oscillation amplitude of the anode current has been examined.

Figure 4:
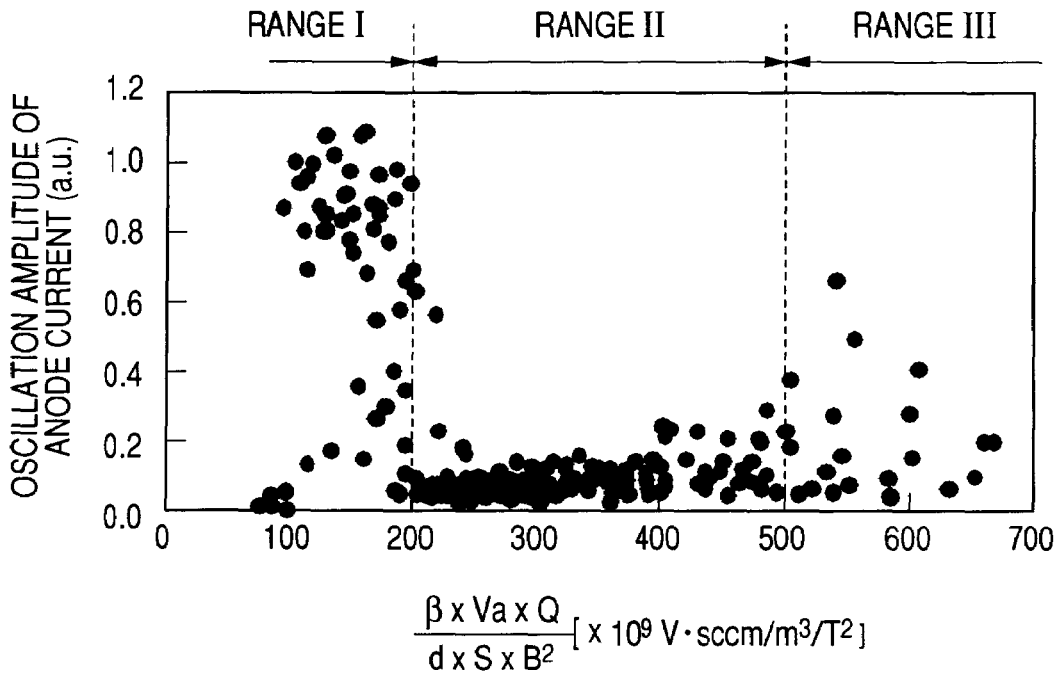
FIG. 4 is a graph exhibiting the oscillation amplitude of the anode current in the first embodiment of this invention.

FIG. 4 is a graph exhibiting the oscillation amplitude of the anode current in the first embodiment of the invention. In FIG. 4, the vertical axis represents the oscillation amplitude of the anode current (magnitude of variation of the current) obtained by measurement. The horizontal axis represents $(\beta \cdot Va \cdot Q)/(d \cdot S \cdot B^2)$. The points plotted on the figure represent measured oscillation amplitude levels of the anode current under the condition of various combinations of the anode voltage Va[V], gas flow rate Q[sccm] and magnetic flux density B[T] proportional to the coil current Ic. The unit "sccm" of the gas flow rate Q is an abbreviation of Standard Cubic Centimeter per Minutes. The oscillation amplitude of the anode current can be acquired from the amplitude of variation of the current waveform of the anode current. In this experiment, the gas flows through the Hall thruster 11 is Xe. The value of the magnetic flux density varies from place to place. In this embodiment, it is assumed that the magnetic flux density in the vicinity of the ion exit of the Hall thruster 11 is B[T], the exit sectional area of the ion exit of the Hall thruster 11 is $S[m^2]$, the ion accelerating region length is d[m] and the magnetic flux bias ratio is β.

It can be seen from FIG. 4 that with the horizontal axis of $(\beta \cdot Va \cdot Q)/(d \cdot S \cdot B^2)$ using Formula (6) standardized on the basis of classic diffusion, where experimental results are plotted, all the data of the oscillation amplitude of the anode current are nearly concentrated on a single curve. In FIG. 4, a range I ($(\beta \cdot Va \cdot Q)/(d \cdot S \cdot B^2) \leqq 200\times10^9$) is a range where very severe oscillation occurs. In a range III ($500\times10^9 < (\beta Va \cdot Q)/(d \cdot S \cdot B^2)$) also, the oscillation of the anode current is slightly great. On the other hand, in a range II ($200\times10^9 < (\beta \cdot Va \cdot Q)/(d \cdot S \cdot B^2) \leqq 500\times10^9$) is a range where the oscillation of the anode current is suppressed and stable operation is obtained.

However, where the command value of the quantity of accelerated ions giving thrust of the Hall thruster 11 is large, it is necessary to increase the anode voltage Va and the gas flow rate Q. Therefore, if the Hall thruster 11 is operated in the range II, it is necessary to increase the coil current Ic to increase the magnetic flux density B also. It is desirable that the device configuration of the Hall thruster 11 and power therefor is designed in the smallest possible scale. Therefore, it is estimated the Hall thruster 11 is mostly operated with the maximum possible thrust. In order to obtain the maximum thrust of the Hall thruster 11, it is necessary to set the value of the magnetic flux density B for a very large value.

The magnetic flux density B is generated by flowing the coil current Ic through the inner coil 13 and the outer coil 14. In the region where the magnetic flux density B is low, the magnetic flux density B is proportional to the coil current Ic. However, if the coil current Ic is further increased, the magnetic flux density B will be saturated. The saturated magnetic flux density that the magnetic flux density B is saturated to the maximum is determined by the structure of each of the coils 13, 14 and the core of each of the coils 13, 14. Thus, in order to acquire a higher saturated magnetic density, the cores with a larger size are required. As a result, the device configuration of the Hall thruster 11 will be upsized. Further, the number of windings of each of the coils 13, 14 will be increased and the coil current Ic will be also increased. Thus, the loss of the electric power in each of the coils 13, 14 becomes much. Accordingly, it is not practical to generated so high a magnetic flux density B.

Figure 5:
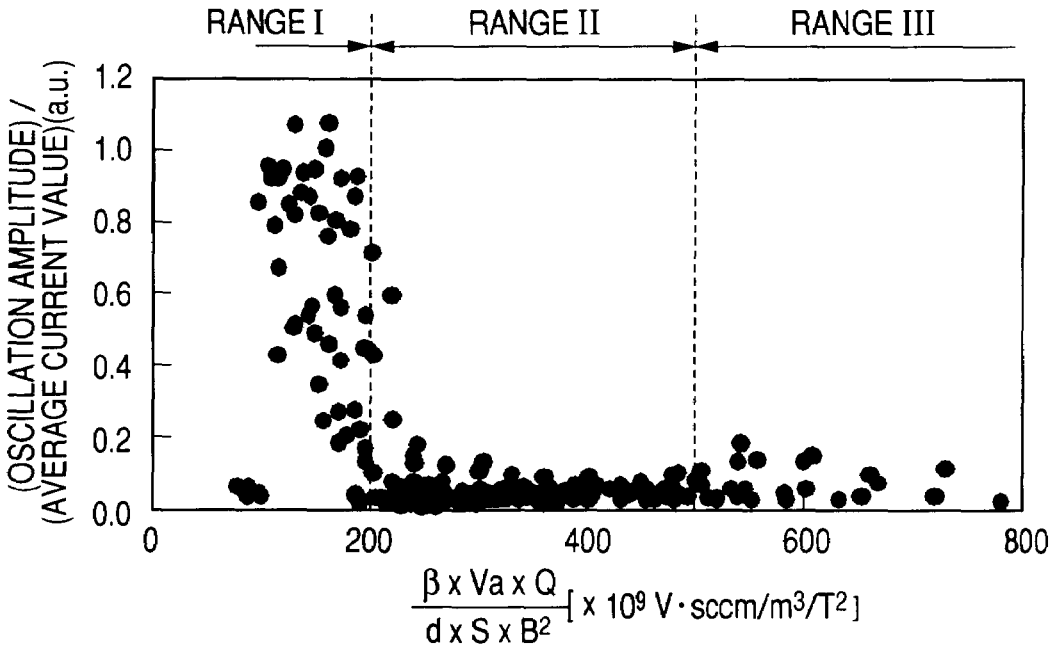
FIG. 5 is a graph exhibiting the oscillation amplitude of the anode current standardized by an average current value in the first embodiment of this invention.

FIG. 5 is a graph exhibiting the oscillation amplitude of the anode current in the first embodiment of the invention. FIG. 5 is different from FIG. 4 in that the vertical axis represents not the oscillation amplitude of the anode current but the oscillation amplitude of the anode current divided by the average current value of the anode current. Namely, the plotted points represent the experimental results standardized by the average current value.

From FIG. 5, it can be seen that in the range III also, the oscillation amplitude of the anode current is not so great. In the range III, the oscillation of the anode current is slightly great, but the average value of the anode current is also large. Therefore, if the oscillation of the anode current is standardized by the average current, the proportion of oscillation of the anode current becomes sufficiently small. In short, if the oscillation amplitude of the anode current is considered in comparison to the current value of the anode current, stable control with sufficiently less oscillation can be realized in the range III also.

When the Hall thruster 11 is operated in the range III, as compared with the case where it is run in the range II, even if the anode voltage Va and the gas flow rate Q are increased and the magnetic flux density B is reduced in order to increase the quantity of accelerated ions which represents the thrust of the Hall thruster 11, the Hall thruster 11 can be stably operated. Namely, the structure of each of the coils 13, 14 and the core of the each of the coils 13, 14 can be downsized and the coil current Ic can be operated so that the Hall thruster 11 can be stably run with less electric power loss. This contributes to realization of downsizing and high efficiency of the Hall thruster 11.

In this way, it can be understood that if high thrust not smaller than a certain degree is required for the Hall thruster 11, the range III may be selected as the operating region of the Hall thruster 11. In short, each of the parameters may be regulated so as to satisfy the following Formula (7).

$$500 \times 10^9 < \frac{\beta \cdot V_a \cdot Q}{d \cdot S \cdot B^2} \tag{7}$$

In the right side of Formula (7), β, d and S are values determined by the shape of the Hall thruster 11. Va, Q and B are the parameters which can be externally adjusted. Va and Q may be regarded as parameters which determine the quantity of accelerated ions of the Hall thruster 11, and B may be regarded as an regulating parameter for stably operating the Hall thruster 11. If the quantity of accelerated ions is increased, Va and Q become high. Namely, in case where the quantity of accelerated ions is increased, the right side of Formula (7) becomes large. In case where the quantity of accelerated ions is decreased, the right side of Formula (7) becomes small.

When the quantity of accelerated ions are gradually increased, the gas flow rate Q or anode voltage Va will be gradually increased. However, the values of the gas flow rate Q and the anode voltage Va which can be output from the system are limited so that they will not be increased unlimitedly. Specifically, considering that there is a limitation as expressed by Formula (7) in changing the quantity of accelerated ions, control is problematic in not in the case where the quantity of accelerated ions is increased but in the case where the quantity of accelerated ions is decreased. When the quantity of accelerated ions is gradually increased, it is not necessary to consider the limitation of Formula (7). On the other hand, when the quantity of accelerated ions is gradually decreased, it is necessary to regulate Va, Q and B not to exceed the boundary value in Formula (7). If they reach the boundary defined by Formula (7), it is necessary to regulate the magnetic flux density B so as to satisfy Formula (7).

Namely, the control unit 9 can suppress occurrence of the discharge oscillation phenomenon by controlling the anode voltage Va, the gas flow rate Q and the magnetic flux density B that depends on the coil current Ic at the ion exit so as to satisfy Formula (7) related to the anode voltage Va and coil current Ic on the basis of the exit sectional area S of the ion exit of the Hall thruster 11 serving as the ion accelerator, the ion accelerating region length d of the ion accelerator and the magnetic flux bias ratio β that is a ratio of the magnetic flux density B at the ion exit to the average value of the magnetic flux density in the ion accelerating direction of the ion accelerator. Thus, it has been clarified that if $(\beta \cdot Va \cdot Q)/(d \cdot S \cdot B^2)$ is controlled to fall within a predetermined range as the condition for driving the Hall thruster 11, the discharge oscillation phenomenon can be theoretically suppressed.

Now, the value exhibited in Formula (7) is directed to the case where Xe gas is employed as a propellant. If the other propellants, e.g. Kr or Ar are employed, it is supposed that the threshold value will be different from that in Formula (7). However, even with the threshold value being different, as the condition for driving the Hall thruster 11, if $(\beta \cdot Va \cdot Q)/(d \cdot S \cdot B^2)$ is controlled to fall within a predetermined range, it is probable that the discharge oscillation phenomenon can be suppressed in the same manner.

Meanwhile, although the magnetic flux density depends on the coil current Ic, it has a likelihood that if the magnetic flux is low, it is nearly proportional to the coil current Ic whereas if the magnetic flux becomes high, it will be saturated regardless of the coil current Ic. In the region where the magnetic flux is not saturated and low, it is suitable to select, as an index, $Va \cdot Q/Ic^2$ that is constituted by the parameters externally controllable. This has been given clear theoretical support and also provides a very clear guide on how the control is done to suppress occurrence of the discharge phenomenon. It is to keep $Va \cdot Q/Ic^2$ within a predetermined range, in other words, to keep the value of the coil current Ic so as to be nearly proportional to the multiplied value of the square root of the anode voltage Va and the square root of the gas flow rate Q as a function related to the anode voltage Va and coil current Ic.

However, it should be noted that this function contains various approximations. First, it has been confirmed by the measurement result that the magnetic flux density is not so strictly proportional to the coil current Ic. The magnetic flux density has a distribution within the Hall thruster 11 and is strongly influenced by the structure of the Hall thruster 11 and others. Therefore, it is difficult to clearly express the relationship between the magnetic flux density and the coil current Ic. Further, the proportional relationship between the gas flow rate Q and the gas density is also based on various approximations, and particularly, the velocity of the gas (temperature of the gas) within the Hall thruster 11 is approximated as constant, so that it is not necessarily to assure the proportional relationship so surely. Since the gas density has a spatial distribution, it is difficult to experimentally acquire the gas density. Therefore, the proportional relationship between the gas flow rate and the gas density is not assured. As regards the relationship between the anode voltage Va and the electric field strength E, as described previously, the distribution of the magnetic flux density and that of the electric field strength are not accurately proportional to each other.

As described above, Formula (6) is strictly an approximated formula and given for convenience. In order to bring Formula (6) close to Formula (3), it is desired that not $Va \cdot Q/Ic^2$ but $E \cdot Nn/B^2$ is an index of control. E, Nn and B exhibit the spatial distribution, respectively so that they cannot be easily controlled. However, if E, Nn and B can be strictly related to Va, Q and Ic, by controlling the respective parameters in accordance with the Formula related to $E \cdot Nn/B^2$, high accuracy control can be realized.

In this way, since the discharge oscillation phenomenon of the Hall thruster 11 is determined by the anode voltage Va, the magnetic flux density B and the gas density depending on the gas flow rate Q, by changing these parameters so as to be related to one another, the operating region in which the operation of the Hall thruster 11 becomes unstable can be avoided. Further, it has been confirmed that occurrence of the discharge oscillation phenomenon depends on the function expressed by $Va \cdot Q/Ic^2$.

As described above, the control unit 9 controls the anode voltage Va, the gas flow rate Q and the coil current Ic in accordance with Formula (7) related to the anode voltage Va, gas flow rate Q and coil current Ic. Therefore, it is possible to provide the power supply apparatus 1 capable of suppressing occurrence of the discharge oscillation phenomenon and stably operating the Hall thruster 11 serving as the ion accelerator.

Embodiment 2

In the first embodiment, the explanation has been given of the case where control is made so that the coil current Ic is nearly proportional to the square root of the anode voltage Va. In this embodiment, an explanation will be given of the case where control is made so that the coil current Ic is nearly proportional to the anode voltage Va. Generally, in the region where the magnetic flux density is low, the electron velocity within the Hall thruster 11 obeys the classical diffusion, but in the region where the magnetic flux density is high, the electron velocity obeys an abnormal diffusion. Where the abnormal diffusion (Bohm diffusion) is assumed, the mobility μa of an electron and velocity of the electron Ve_a can be expressed by Formula (8) and Formula (9).

$$\mu_a = \frac{1}{16B} \tag{8}$$

$$V_{e_a} \cong \mu_a E \propto \frac{\beta \cdot V_a}{d \cdot B} \propto \frac{V_a}{I_c} \tag{9}$$

Figure 6:
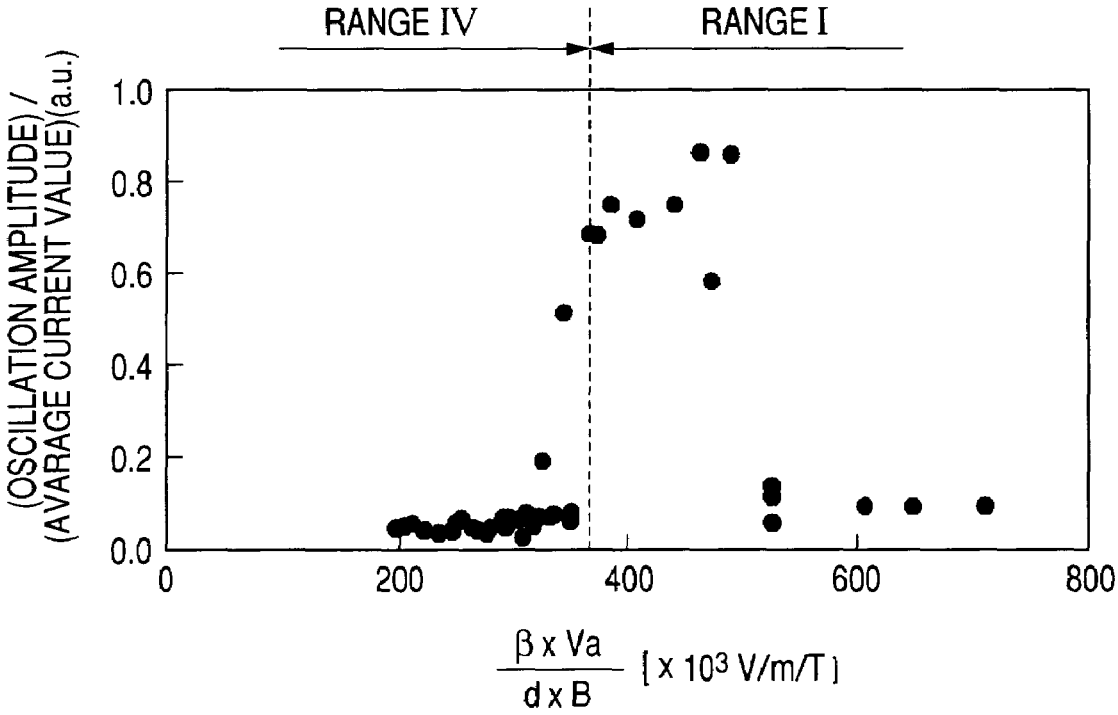
FIG. 6 is a graph showing the oscillation amplitude of the anode current standardized by an average current value in the second embodiment of this invention.

It can be understood that the data in the range II illustrated in FIG. 4 falls in the region with the classical diffusion. The data in the region where the magnetic flux density is higher than the region related to the above data are plotted in FIG. 6. FIG. 6 is a graph showing the oscillation amplitude of the anode current standardized by the average current value in the second embodiment of the invention. In FIG. 6, the vertical axis represents the oscillation amplitude of the measured anode current divided by the average value of the measured anode current. Namely, the oscillation amplitude of the anode current is standardized by the average current value. The horizontal axis represents $(\beta \cdot Va)/(d \cdot B)$. The points plotted on the figure exhibit oscillation amplitude levels of the anode current measured under the condition of various combinations of the anode voltage Va [V] and the magnetic flux density B[T] proportional to the coil current Ic. The oscillation amplitude of the anode current can be acquired from the varying amplitude of the current waveform of the anode current. In this experiment, the gas flowing through the Hall thruster 11 is Xe (xenon). The value of the magnetic flux density varies from place to place. In this embodiment, it is assumed that the magnetic flux density in the vicinity of the ion exit of the Hall thruster 11 is B[T]. Further it is assumed that the ion accelerating region length in the Hall thruster 11 is d[m] and the magnetic flux bias ratio is β.

The data exhibited in FIG. 6 are the data in the region of the abnormal diffusion, particularly the Bohm diffusion according to Formula (8). As shown in FIG. 6, when the data are plotted assuming that the horizontal axis represents $(\beta \cdot Va)/(d \cdot B)$, the data with different anode voltages Va are nearly concentrated on a certain curve. Further, it can be seen that there is a stable range IV with less oscillation in a range where $(\beta \cdot Va)/(d \cdot B)$ is smaller than in the above range with respect to a border line. For this reason, it can be seen that the range IV should be selected as an operating region of the Hall thruster 11. Namely, it can be seen that the respective parameters should be regulated so as to satisfy the following Formula (10).

$$0 \le \frac{\beta \cdot V_a}{d \cdot B} < 370 \times 10^3 \tag{10}$$

In the range IV, although oscillation of the anode current is not relatively likely to occur, the magnetic flux density B is so high that the coils 13, 14 are large in size and the power loss due to the coil current Ic is large. Therefore, this range is not preferable from the point of view of realization of downsizing and high efficiency of the device of the Hall thruster 11. Particularly, if it is desired that high thrust should be given to the Hall thruster 11, the range IV is not preferable. However, since the range II illustrated in FIG. 4 intervenes between the ranges I and III, for example, by secular changes, the range which can be stably operated may be narrowed. In such a case, it is difficult to provide a stable operation in the range II so that by operating the Hall thruster 11 in the range IV illustrated in FIG. 6, stable control can be easily done.

Thus, in the region where the abnormal diffusion is predominant to further increase the magnetic flux density B, it is suitable to make the control so that $(\beta \cdot Va)/(d \cdot B)$ or Va/Ic falls within a predetermined range, i.e. the coil current Ic is nearly proportional to the anode voltage Va as a function related to the anode voltage Va and coil current Ic. The control according to Formula (7) and control according to Formula (10) are directed to entirely different phenomena. Therefore, it is necessary to determine the Formula which the control obeys. In other words, it is concluded that the control unit 9 makes the control in accordance with the classical diffusion region or in the abnormal diffusion region in which the Hall thruster 11 operates, which is previously determined by the design of the Hall thruster 11.

In the classical diffusion region, if the discharge oscillation phenomenon is detected, it is suitable to control the coil current Ic to be small. However, in the abnormal diffusion region as expressed by Formula (10), if the discharge phenomenon occurs, it is suitable to control the coil current Ic to be large. Meanwhile, in Formula (10), only the upper limit is defined and the lower limit is not defined. However, the lower limit of the value is naturally determined in view of the capability of the device. Since the anode voltage Va is related to the propulsive force of the Hall thruster 11, it cannot be reduced so greatly. On the other hand, since the magnetic flux density is saturated even if a large coil current Ic flows, the magnetic flux density B has a certain upper limit value. Incidentally, in igniting the Hall thruster 11 or boosting the anode voltage, the voltage increases from zero so that the left side of Formula (10) will change from zero.

As described above, since the control unit 9 controls the anode voltage Va and the coil current IC in accordance with Formula (10) related to the anode voltage Va and the coil current Ic, it is possible to provide the power supply apparatus 1 capable of suppressing occurrence of the discharge oscillation phenomenon and stably operating the Hall thruster 11 serving as the ion accelerator.

Embodiment 3

As described with reference to the first embodiment, by performing the control in accordance with Formula (7), the discharge oscillation phenomenon can be avoided. When the Hall thruster 11 is actually operated, the control is performed in combination of the values of the anode voltage Va, the gas flow rate Q and the coil current Ic in accordance with Formula (7). However, due to any factor such as deterioration of the Hall thruster 11, the value of the magnetic flux density B corresponding to the coil current Ic varies so that the driving condition or condition of oscillation occurrence may change and hence the discharge oscillation phenomenon, i.e. oscillation of the anode current may occur. An explanation will be given of the manner of suitable control in such a case.

First, it is assumed that the Hall thruster 11 is operated in the classical diffusion region, i.e. the ranges illustrated in FIG. 4 or FIG. 5. In this case, the respective parameters may be controlled so that $(\beta \cdot Va \cdot Q)/(d \cdot S \cdot B^2)$ falls in the range II or III. Among these parameters, β, d and S are determined by the shape of the Hall thruster 11. The other three parameters can be adjusted from the external of the Hall thruster 11. The anode voltage Va and gas flow rate Q may be regarded as the parameters which determine the quantity of accelerated ions of the Hall thruster 11, and the magnetic flux density B may be regarded as an regulating parameter for stably operating the Hall thruster 11.

If the quantity of accelerated ions increases, the anode voltage Va and gas flow rate Q increase. Namely, if the quantity of accelerated ions is increased, $(\beta \cdot Va \cdot Q)/(d \cdot S \cdot B^2)$ becomes large. If the quantity of accelerated ions is decreases, $(\beta \cdot Va \cdot Q)/(d \cdot S \cdot B^2)$ becomes small. When the quantity of accelerated ions is increased, the gas flow rate Q or the anode voltage Va will be gradually increased. However, the values of the gas flow rate Q and the anode voltage Va which can be output from the system are limited so that they will not be increased unlimitedly. Specifically, considering that there is such a limitation as in the range II in changing the quantity of accelerated ions, control is problematic in not in the case where the quantity of accelerated ions is increased but in the case where the quantity of accelerated ions is decreased.

When the quantity of accelerated ions is gradually increased, as described in connection with the first embodiment, it is not necessary to consider the boundary of the range II. On the other hand, where the quantity of accelerated ions is gradually decreased, it is necessary to regulate the parameters while attention is paid so that $(\beta \cdot Va \cdot Q)/(d \cdot S \cdot B^2)$ does not exceed the boundary value between the ranges I and II. If $(\beta \cdot Va \cdot Q)/(d \cdot S \cdot B^2)$ reaches the boundary value, it is necessary to regulate the magnetic flux density B so that $(\beta \cdot Va \cdot Q)/(d \cdot S \cdot B^2)$ falls in the range II. For this reason, where the thrust condition for the Hall thruster 11 is changed, the control of the parameters, particularly the control of the coil current Ic becomes more strict not in the case where the thrust of the Hall thruster 11 is increased but in the case where the thrust of the Hall thruster 11 is decreased.

Next, an explanation will be given of the manner of suitable control in such a case where the oscillation of the anode current occurs due to e.g. deterioration of the Hall thruster 11. When the discharge oscillation phenomenon abruptly starts to occur due to any change of the state, there is the greatest possibility that the Hall thruster 11 is operated in the vicinity of the boundary between the ranges I and II illustrated in FIG. 4 and $(\beta \cdot Va \cdot Q)/(d \cdot S \cdot B^2)$ has exceeded to fall in the range I. Therefore, in order that it goes out from the range I and enters the range II, it is proposed that the anode voltage Va or gas flow rate Q is increased or the coil current Ic is decreased. However, in many cases, the anode voltage Va and gas flow rate Q, which are values for determining the propulsive capability of the Hall thruster 11, cannot be changed for control. Further, it takes a long time to change the gas flow rate itself so that it is not easy to do the control by changing the gas flow rate Q. Thus, it is most suitable to control the coil current Ic. In order that $(\beta \cdot Va \cdot Q)/(d \cdot S \cdot B^2)$ enters the range II from the range I, the coil current Ic may be decreased and the magnetic flux density B may be reduced. Namely, it can be understood that when the discharge oscillation phenomenon has occurred during the operation of the Hall thruster 11, the coil current Ic may be decreased.

Figure 7:
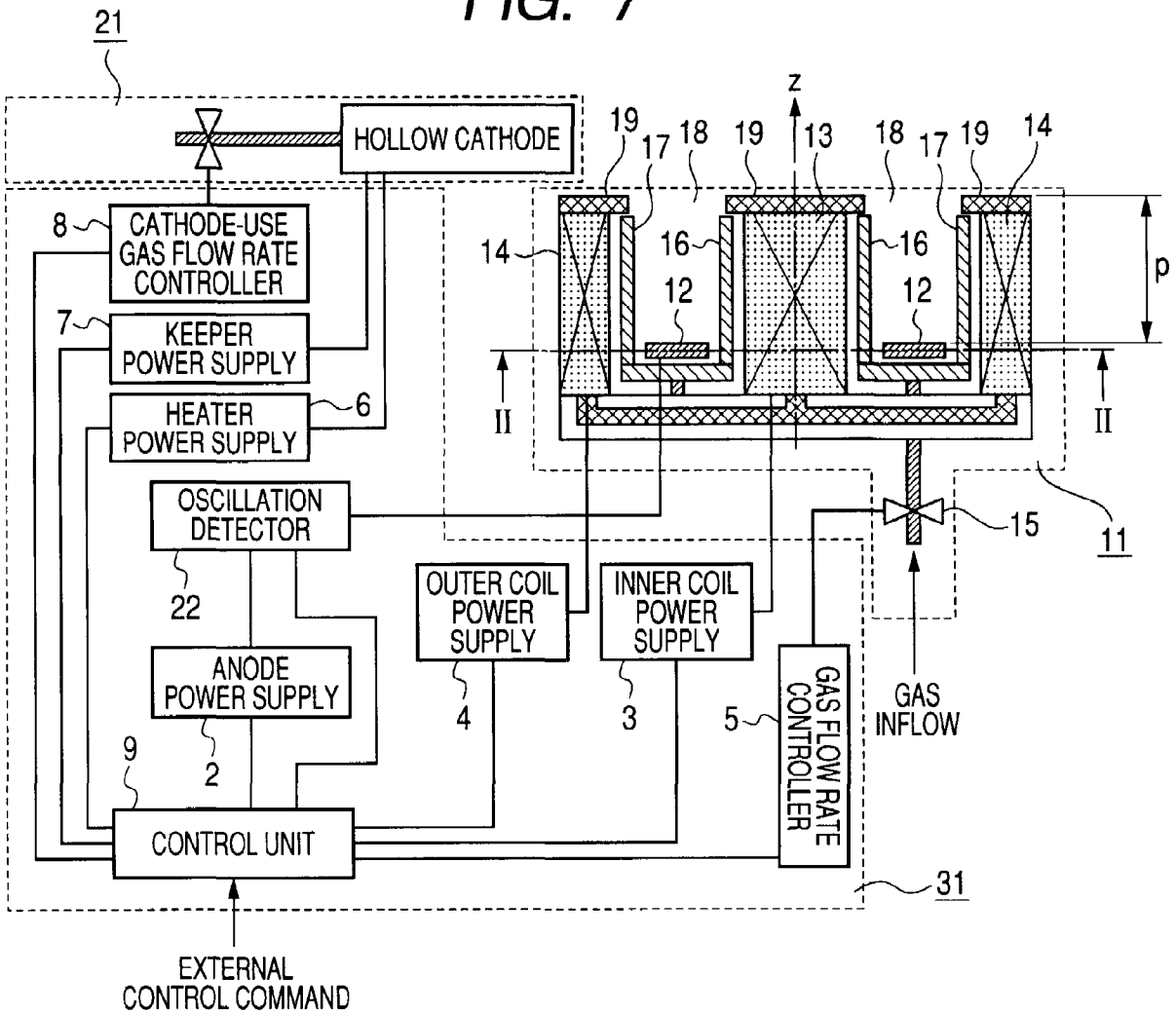
FIG. 7 is a block diagram of a power supply apparatus in the third embodiment of this invention.

Occurrence of the discharge oscillation phenomenon can be detected by measuring the anode current flowing through the anode electrode. FIG. 7 is a block diagram of a power supply apparatus in the third embodiment of the invention. This embodiment is different from the first embodiment in that a power supply apparatus 31 includes an oscillation detector 22 serving as an oscillation detecting means for detecting occurrence of the anode current. In this embodiment, the detector 22 measures the anode current value which will be fetched into the control unit 9 and the control unit 9 analyses occurrence state of oscillation of the anode current. There may be a case where the oscillation of the anode current occurs when the Hall thruster 11 is operated in the boundary between the ranges II and III and $(\beta \cdot Va \cdot Q)/(d \cdot S \cdot B^2)$ enters the range III so that the oscillation of the anode current has become severe. In this case, of course, inversely, it is necessary to perform the control to increase the coil current Ic and return $(\beta \cdot Va \cdot Q)/(d \cdot S \cdot B^2)$ to the range II. Further, in order to determine that the discharge oscillation phenomenon has occurred due to whether $(\beta \cdot Va \cdot Q)/(d \cdot S \cdot B^2)$ has entered the range I or III, there are methods of determining a range near to the range I or III in which the Hall thruster has been essentially operated, or the amplitude of the discharge oscillation. It should be noted that in the range I, much sever oscillation occurs.

When the discharge oscillation phenomenon has been detected, the following feedback control may be performed. First, the coil current Ic is decreased. Then, if the discharge oscillation becomes weak, it is determined that $(\beta \cdot Va \cdot Q)/(d \cdot S \cdot B^2)$ has entered a stable range. Inversely, if the discharge oscillation becomes severe, the coil current Ic is increased. In this case also, immediately after occurrence of the discharge oscillation has been detected, it is desirable that the control is performed so that the coil current Ic is not first increased but decreased. The reason therefor is as follows. Where $(\beta \cdot Va \cdot Q)/(d \cdot S \cdot B^2)$ resides in the boundary of the range I, if the coil current Ic is increased, the discharge oscillation abruptly becomes severe so that the power supply and system may be adversely affected. Where $(\beta \cdot Va \cdot Q)/(d \cdot S \cdot B^2)$ resides in the boundary of the range III, if the coil current Ic is decreased, although the discharge oscillation becomes severe, the degree of becoming severe is much gentler than in the case in the vicinity of the range I. Therefore, adverse effect for the power supply and system can be suppressed sufficiently low.

Now, it is supposed that the Hall thruster 11 operates not in the region of classical diffusion but in the region of Bohm diffusion. In this case, if occurrence of the oscillation of the anode current is detected, it is necessary to control the Hall thruster to enter $(\beta \cdot Va)/(d \cdot B)$ into the range IV illustrated in the second embodiment by increasing inversely increasing the coil current Ic, contrary to the case in the classical diffusion. Hitherto, although the explanation has been given of the control of the coil current Ic in the case where the discharge oscillation phenomenon has occurred, it is needless to say that such a control can be applied to not only the case where the Hall thruster 11 is being operated by a predetermined thrust, but also to the case where the Hall thruster 11 is ignited, the anode voltage is boosted, or the propulsive condition for the Hall thruster 11 is changed to change the anode voltage Va and gas flow rate Q.

As described above, since the occurrence of the oscillation of the anode current can be detected by measuring the anode current flowing through the anode electrode, there is provided the power supply apparatus 31 capable of suppressing occurrence of the discharge oscillation and of stably operating the Hall thruster 11 serving as the ion accelerator.

In all the embodiments, the explanation has been given of the Hall thruster serving as the ion accelerator which is the propelling device for an artificial satellite. However, this invention may be applied to the case where the device similar to the Hall thruster is employed as an ion source device. Further, this invention can be generally widely applied to not only an annular-shaped ion source device but also the device including three factors of flowing gas, applying voltage and generating magnetic field.

What is claimed is:

1. A power supply apparatus for controlling an ion accelerator that includes an anode electrode, a gas flow rate regulator and a magnetic field generating coil, the power supply apparatus comprising:

a controller configured to control: an anode voltage applied to the anode electrode; a gas flow rate of gas flowing through the gas flow rate regulator; and magnetic flux density at an ion exit of the ion accelerator by controlling coil current flowing through the magnetic field generating coil, thereby adjusting magnitude of ion acceleration in the ion accelerator, wherein, based on: a sectional area of the ion exit of the ion accelerator; an ion accelerating region length of the ion accelerator; and a magnetic flux bias ratio indicating a ratio of the magnetic flux density at the ion exit to an average value of the magnetic flux density in an ion accelerating direction of the ion accelerator, the controller controls the anode voltage, the gas flow rate and the magnetic flux density at the ion exit that depends on the coil current, in order to satisfy a formula given as follows:

$$500 \times 10^9 < \frac{\beta \cdot V_a \cdot Q}{d \cdot S \cdot B^2}$$

where

S: sectional area of the ion exit [$m^2$];

d: ion accelerating region length [m];

β: magnetic flux bias ratio;

Va: anode voltage [V];

Q: gas flow rate [sccm]; and

B: magnetic flux density at the ion exit [T].

2. The power supply apparatus according to claim 1, further comprising an oscillation detector configured to detect an oscillation of the anode current flowing through the anode electrode, wherein when the oscillation detector detects occurrence of the oscillation of the anode current, the controller controls the coil current to be reduced.

3. A power supply apparatus for controlling an ion accelerator that includes an anode electrode, a gas flow rate regulator and a magnetic field generating coil, the power supply apparatus comprising:

a controller configured to control: an anode voltage applied to the anode electrode; a gas flow rate of gas flowing through the gas flow rate regulator; and magnetic flux density at an ion exit of the ion accelerator by controlling coil current flowing through the magnetic field generating coil, thereby adjusting magnitude of ion acceleration in the ion accelerator, wherein, based on an ion accelerating region length of the ion accelerator and a magnetic flux bias ratio indicating a ratio of the magnetic flux density at the ion exit to an average value of the magnetic flux density in an ion accelerating direction of the ion accelerator, the controller controls the anode voltage and the magnetic flux density at the ion exit that depends on the coil current to satisfy a formula given as follows:

$$0 \le \frac{\beta \cdot V_a}{d \cdot B} < 370 \times 10^3$$

where d: ion accelerating region length [m];

β: magnetic flux bias ratio;

Va: anode voltage [V]; and

B: magnetic flux density at the ion exit [T].

4. The power supply apparatus according to claim 3, further comprising an oscillation detector configured to detect an oscillation of the anode current flowing through the anode electrode, wherein when the oscillation detector detects occurrence of the oscillation of the anode current, the controller controls the coil current to be increased.

* * * * *